US010988895B2

(12) United States Patent
Kim et al.

(10) Patent No.: US 10,988,895 B2
(45) Date of Patent: Apr. 27, 2021

(54) LAUNDRY TREATING APPARATUS

(71) Applicant: LG ELECTRONICS INC., Seoul (KR)

(72) Inventors: Shinwon Kim, Seoul (KR); Ingeun Ahn, Seoul (KR); Seonil Heo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 26 days.

(21) Appl. No.: 16/386,559

(22) Filed: Apr. 17, 2019

(65) Prior Publication Data

US 2019/0323164 A1 Oct. 24, 2019

(30) Foreign Application Priority Data

Apr. 18, 2018 (KR) ..... 10-2018-0045253

(51) Int. Cl.
*D06F 58/24* (2006.01)
*D06F 58/04* (2006.01)
(Continued)

(52) U.S. Cl.
CPC ..... *D06F 58/24* (2013.01); *D06F 58/04* (2013.01); *D06F 58/26* (2013.01); *D06F 58/30* (2020.02); *D06F 58/38* (2020.02); *D06F 2103/08* (2020.02)

(58) Field of Classification Search
CPC ..... D06F 58/24; D06F 58/30; D06F 58/04; D06F 58/26; D06F 2103/08; D06F 58/38
(Continued)

(56) References Cited

U.S. PATENT DOCUMENTS 7,275,400 B2 * 10/2007 Severns ..... F26B 21/14 68/18 F
8,347,520 B2 * 1/2013 Kuwabara ..... D06F 58/206 34/73
(Continued)

FOREIGN PATENT DOCUMENTS

CN 101363187 2/2009
CN 102086582 6/2011
(Continued)

OTHER PUBLICATIONS

Korean Office Action issued in Application No. 10-2018-0045253 dated May 31, 2019.
(Continued)

*Primary Examiner* — Stephen M Gravini
(74) *Attorney, Agent, or Firm* — Ked & Associates LLP

(57) ABSTRACT

A laundry treating apparatus may comprise a cabinet that defines an exterior design; a drum rotatably mounted in the cabinet and configured to accommodate laundry; a drive unit or motor configured to rotate the drum; a hot air supply unit or hot air blower configured to supply high-temperature air to the drum and in communication with the drum; a collection portion or liquid chamber provided to collect water condensed from the drum and in communication with the hot air supply unit; and a drainage pump configured to discharge the water collected in the collection portion outside the cabinet such that the laundry treating apparatus may sense whether the condensate collected in the collection portion is frozen and thaw the frozen condensate. A control method of the laundry treating apparatus may be provided to thaw and operate the laundry treating apparatus.

34 Claims, 8 Drawing Sheets

(51) Int. Cl.

| | |
|---|---|
| ***D06F 58/26*** | (2006.01) |
| ***D06F 58/30*** | (2020.01) |
| ***D06F 58/38*** | (2020.01) |
| ***D06F 103/08*** | (2020.01) |

(58) Field of Classification Search
USPC ..... 34/132, 595–610
See application file for complete search history.

(56) References Cited

U.S. PATENT DOCUMENTS

| | | | | |
|---|---|---|---|---|
| 8,393,090 | B2 | 3/2013 | Kang | |
| 2003/0079368 | A1* | 5/2003 | Hoffman | F26B 5/045 34/202 |
| 2005/0066538 | A1* | 3/2005 | Goldberg | D06F 25/00 34/218 |
| 2008/0235977 | A1* | 10/2008 | Kuwabara | D06F 58/206 34/77 |
| 2009/0158928 | A1 | 6/2009 | Wu et al. | |
| 2013/0239336 | A1 | 9/2013 | Kim et al. | |
| 2015/0168064 | A1* | 6/2015 | Ingrosso | D06F 58/30 34/487 |
| 2016/0160419 | A1* | 6/2016 | Ryoo | D06F 58/30 68/12.14 |
| 2019/0323164 | A1* | 10/2019 | Kim | D06F 58/24 |

FOREIGN PATENT DOCUMENTS

| | | | | |
|---|---|---|---|---|
| CN | 103025945 | | 4/2013 | |
| CN | 103547728 | | 1/2014 | |
| CN | 205803956 | | 12/2016 | |
| EP | 1983094 | A1 * | 10/2008 | D06F 58/206 |
| EP | 2 415 927 | | 2/2012 | |
| EP | 3 023 531 | | 5/2016 | |
| EP | 3556931 | A1 * | 10/2019 | D06F 58/24 |
| JP | 2010-220845 | | 10/2010 | |
| JP | 4889545 | B2 * | 3/2012 | D06F 58/206 |
| JP | 2017-189297 | | 10/2017 | |
| KR | 20080089232 | A * | 10/2008 | D06F 58/206 |
| KR | 20090126220 | A * | 12/2009 | F27B 5/04 |
| KR | 10-2012-0004275 | | 1/2012 | |
| KR | 10-2012-0012213 | | 2/2012 | |
| WO | WO-2019203566 | A1 * | 10/2019 | D06F 58/26 |

OTHER PUBLICATIONS

European Search Report issued in Application No. 19169886.9 dated Jul. 8, 2019.
International Search Report dated Aug. 6, 2019 issued in Application No. PCT/KR2019/004638.
Chinese Office Action dated Jan. 25, 2021 issued in Application No. 201910312962.3 (English translation attached).

* cited by examiner (a)

(b)

(a)

(b)

(a)

(b)

LAUNDRY TREATING APPARATUS

CROSS-REFERENCE TO RELATED APPLICATION(S)

This application claims priority under 35 U.S.C. § 119 to Korean Application No. 10-2018-0045253 filed on Apr. 18, 2018, whose entire disclosure is hereby incorporated by reference.

BACKGROUND

1. Field

Embodiments of the present disclosure relate to a laundry treating apparatus which may sense a frozen or freezing condensate and thaw the frozen condensate automatically and a control method of the same.

2. Background

A laundry treating apparatuses may be categorized into washing machine, dryers, refreshers, etc. The refresher refers to an apparatus configured to remove dust or bacteria, for example, from clothes that are worn by users more than once (e.g., LGE TROMM Styler as the product name).

A dryer may be classified as an exhaustion type dryer or a circulation type dryer. Both of these types of perform drying by using hot air generated from air heated by a heater and exposing the hot air to the clothes.

In a conventional dryer, the hot air, having penetrated the clothes to dry clean, will contain a lot of moisture or water. The high-temperature and high-humidity hot air containing the moisture may be discharged outside of a drum and become a low-temperature air while passing through a duct or heat exchanger. The moisture may be condensed as it passes through the duct or heat exchanger.

Condensate or condensation is collected in an auxiliary collection unit or device by a preset amount and discharged to a drainage pump, completing a drying process. The auxiliary collection unit may also be referred to as a collection unit. However, when the temperature falls in the winter, the condensate collected and remaining in the auxiliary collection unit is likely to become frozen, and the auxiliary collecting unit may burst.

If the condensate is frozen or in the process of freezing, the volume of the condensate may become expanded enough to break or burst the collection unit. Also, if the dryer is actuated or turned on in such a frozen state, the condensate might accumulate on frozen ice and there might be water leakage.

In addition, if the drainage pump, constrained by frozen water is forcefully actuated, a motor provided to drive the drainage pump might be damaged. Accordingly, it may be necessary to determine whether the condensate is frozen in the collecting unit. If it is sensed that the condensate is frozen, the frozen condensate may be thawed quickly.

However, the conventional dryer fails to properly sense whether the condensate is frozen, which may hinder a user in taking spontaneous action to thaw the frozen condensate.

Accordingly, the conventional dryer has a disadvantage in that the drainage pump may be damaged or constrained when it is forcedly or forcefully actuated when the dryer is in frozen state. Further, operation of the dryer may be shut off by the constrained drainage pump.

In addition, the conventional dryer is not able to thaw frozen or freezing condensate automatically. Accordingly, even after finding out that the condensate is frozen, the user may have to pour hot water in the conventional dryer or wait until it thaws naturally.

BRIEF DESCRIPTION OF THE DRAWINGS

Embodiments will be described in detail with reference to the following drawings in which like reference numerals refer to like elements, and wherein.

DETAILED DESCRIPTION

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. A singular representation may include a plural representation unless it represents a definitely different meaning from the context. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

The laundry treating apparatus 10 may be provided as a washing machine configured to perform a washing process for clothes, a dryer configured to perform a drying process for clothes, or a styler or refresher configured to prevent or smooth wrinkles formed on clothes and removing bad smell from clothes.

Hereinafter, an embodiment where the laundry treating apparatus 10 is provided as a dryer will be described for convenience, although embodiments disclosed herein are not limited thereto. The laundry treating apparatus 10 may be provided as a washing machine or a dryer, for example.

Figure 1:
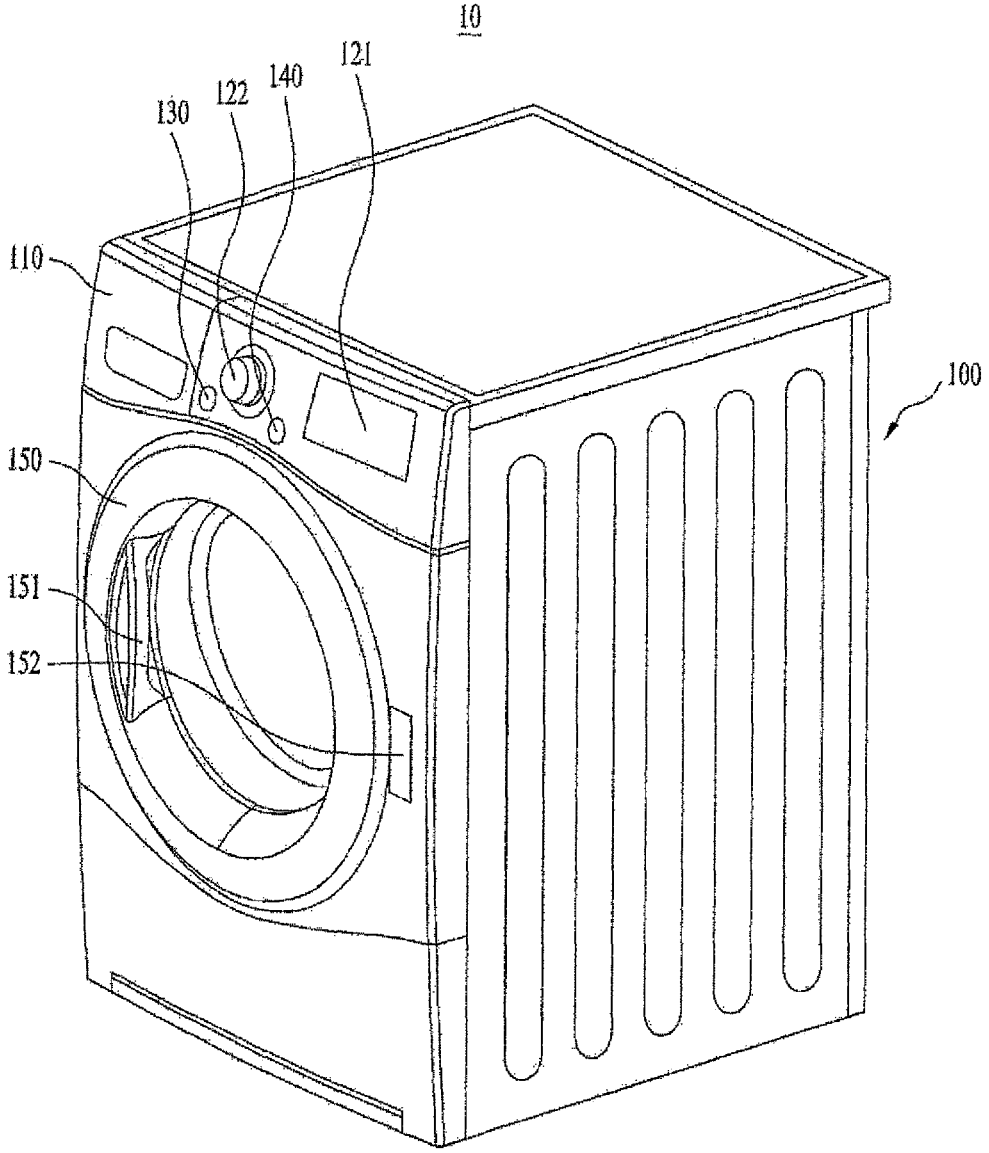
FIG. 1 is a diagram illustrating an exterior design of a laundry treating apparatus.

FIG. 1 is a diagram illustrating an exterior design of the laundry treating apparatus 10. The laundry treating apparatus 10 may include a cabinet 100 that defines the exterior design of the laundry treating apparatus 10; a control panel 120 provided on the cabinet 100 and configured to receive an input of an operation command or to display a current state of the laundry treating apparatus 10; a door 150 rotatably coupled to a front of the cabinet 100 and configured to open and close a laundry introduction opening or opening 101 of the cabinet 100 formed to load and remove clothes; and a condensate tank or tank 110 provided to collect a condensate therein. The condensate tank 110 may also be referred to as an accommodation tank.

The control panel 120 may be connected to an upper end of the cabinet 100, and a controller P including a microcomputer implemented to control the laundry treating apparatus 10 may be provided in the control panel 120. The control panel 120 may include a display unit or display 121 configured to display a current state of the laundry treating apparatus 10; and an input unit or device (e.g., a button or a knob) configured to allow a user to input a command to the controller P.

The display unit 121 may be a display screen configured of liquid crystalized display (LCD) or liquid emitting diodes (LED) or a touch panel configured to receive an input of a command. The display unit 121 may display an operational state or an abnormal state of the laundry treating apparatus 10 to transmit accurate information about the laundry treating apparatus to the user. In addition, the display unit 121 may further include a speaker to provide the user with an alarm.

The input unit may include a rotary knob or button 122 to allow the user to freely select a drying course or option. The input unit may also include a power input unit or button 140 configured to input the power of the laundry treating apparatus 10; and a command input unit or interface 130 configured to input an additional control command.

The power input unit 140 and the command input unit 130 may be physical buttons to transmit commands even when the power is not supplied to the display unit 121.

The command input unit 130 may include a thaw command input unit configured to transmit a command to thaw the laundry treating apparatus 10 when it is frozen or burst.

The door 150 may be rotatably coupled to the front of the cabinet 100 and formed of a transparent material to make the opening of the cabinet 100 visible.

The door 150 may include a handle 151 provided on one or a first side and a hinge 152 provided on the outer or a second side to open and close the opening of the cabinet 100.

FIG. 1 illustrates that the door 150 is provided at a front of a front load type dryer. However, embodiments disclosed are not limited to a front laundry treating apparatus, and the door 150 may be provided on a top of a top load type dryer, for example.

Figure 2:
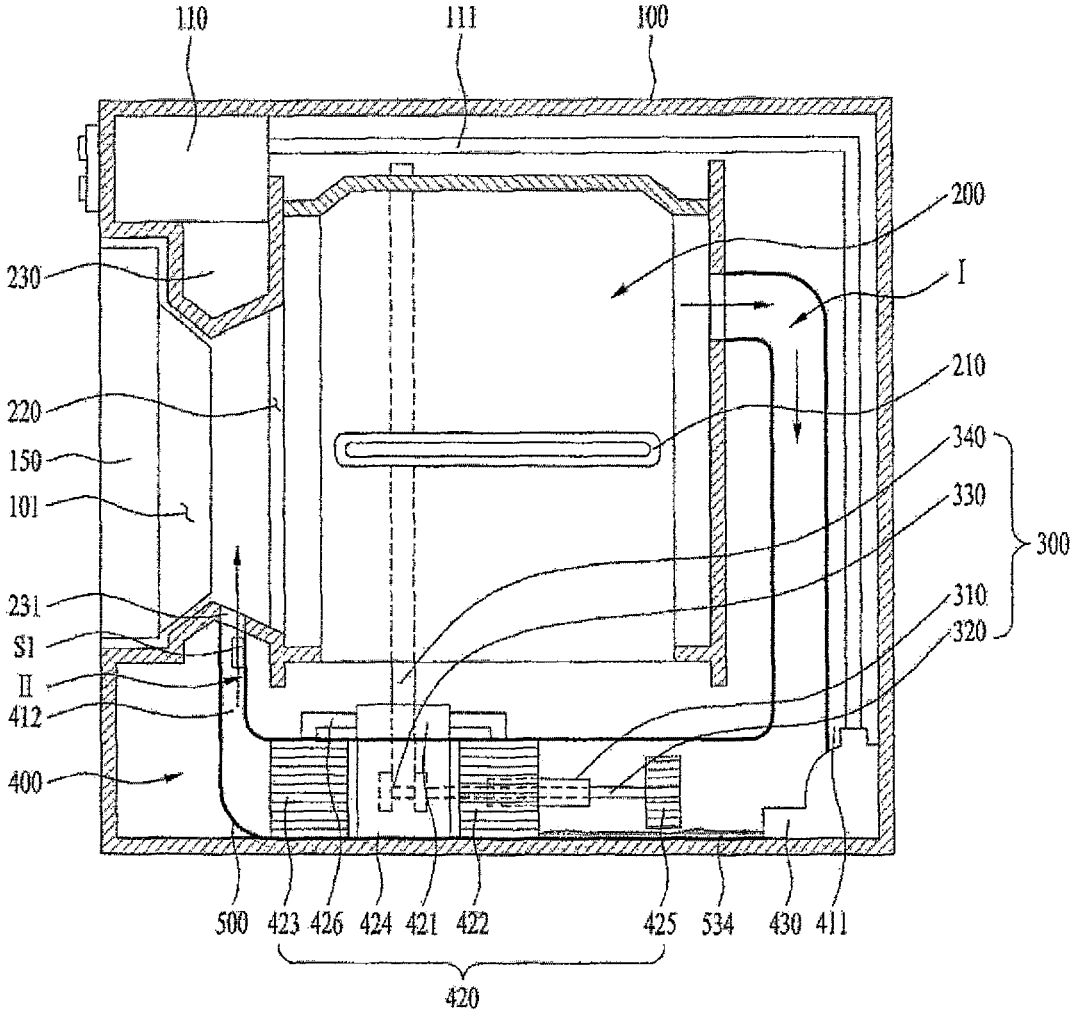
FIG. 2 is a sectional diagram of the laundry treating apparatus.

FIG. 2 is a sectional diagram illustrating an inner structure of the laundry treating apparatus 10. The laundry treating apparatus 10 may include a drum 200 rotatably mounted in the cabinet 100 and configured to hold clothes; a drive unit or motor 300 configured to rotate the drum 200; a hot air supply unit or hot air blower 400 configured to supply hot air to the drum 200; and a base 500 provided to support or install the hot air supply unit 400.

The drum 200 may include a laundry introduction opening 220 provided to load and unload the laundry and may be in communication with the opening 101 of the cabinet 100. The laundry introduction opening 220 may have a cylinder shape to accommodate the laundry therein. Also, the drum 200 may further include a lifter 210 provided to lift and agitate the laundry. The laundry treating apparatus 10 may further include a gasket 230 provided between the opening 101 and the laundry introduction opening 220 of the drum 200 to prevent the laundry from being discharged through the opening 101.

The hot air supply unit 400 may include an outlet or discharge duct 411 provided to discharge the moisture of the laundry and the air having passed through the laundry from the drum 200. The outlet duct 411 may be in communication with one side of the drum 200. The hot air supply unit 400 may further include a heat pump 420 configured to chill the air having passed through the outlet duct 411, remove the moisture from the air, and re-heat the air; and an inlet duct 412 configured to suck the air having passed through the heat pump 420 into the drum 200. The gasket 230 may include a duct connection hole 231 provided to communicate with the inlet duct 412.

The heat pump 420 may include an evaporator 422 configured to chill the air or evaporate a refrigerant having passed the outlet duct 411; a compressor 421 configured to compress and heat refrigerant having passed through the evaporator 422; a condenser 423 configured to heat the air by using the refrigerant that passed through the compressor 421 to generate high-temperature dry hot air; and an expansion valve 424 configured to expand the refrigerant that passed through the condenser 423 to lower the temperature.

In an embodiment, the base 500 may define a bottom surface of the laundry treating apparatus 10 while supporting the heat pump 420. The base 500 may have a first end in communication with the outlet duct 411 and a second end in communication with the inlet duct 412. The heat pump 420 may be installed in the base 500 such that air may penetrate the base 500. Accordingly, water condensed from the evaporator 422 may be collected in the base 500, and a drainage pump 430 configured to discharge the collected water may be installed in the base 500.

A collection portion or liquid chamber 534 may be provided in a lower area of the base 500 to collect the condensed water (hereinafter, the condensate). The collection portion 534 may also be referred to as a condensate collector. The drainage pump 430 may drain the condensate collected in the collection portion 543. Also, the drainage pump 430 may transfer the collected water to the communication tank 110 via an accommodation pipe 111 connected to the drainage pump 430. Accordingly, when the condensate is collected in the base 500 by a preset or predetermined amount, the collected condensate may be transferred to the accommodation tank 110, and the user may take out the accommodation tank 110 to remove the collected condensate.

In an embodiment, the drive unit 300 may be provided to rotate the drum 200. The drive unit 300 may include a drive motor or motor 310 configured to provide power to rotate the drum 200; a drive shaft or shaft 320 that is rotary through the drive motor 310; a pulley 330 coupled to a first end of the drive shaft 320; and a belt 340 formed in a closed curve or loop connected to an outer circumferential surface of the drum 200.

The hot air supply unit 400 may be coupled to the drive shaft 320. For example, a circulation fan or fan 425 configured circulate internal air of the drum 200 may be connected to a second end of the drive shaft 320. The circulation fan 425 may be installed in the hot air supply unit 400 or in an area in communication with the hot air supply unit 400 so as to circulate the air in the drum 200 and the hot air supply unit 400. Accordingly, when the drive motor 310 is actuated or turned on, the drum 200 may be rotated and the circulation fan 425 may circulate the internal air of the drum 200. After blowing the internal air of the drum 200 via the discharge duct 411 in an I-direction, the circulation fan 425 may load the air into the inlet duct 412 in an II-direction via the base 500 and the hot air supply unit 400.

In an embodiment, the laundry treating apparatus 10 may include a temperature sensor S1 configured to sense a temperature of the air passed through the drum 200 or the hot air supply unit 400. The temperature sensor S1 may be provided in the hot air supply unit 400.

As one example, the temperature sensor S1 may be provided in the inlet duct 412 and sense a change in the temperature of the air passed through the hot air supply unit 400. Accordingly, overall check-up for a drying state of the laundry and an operational state of the heat pump 420, as well as a variation of the air temperature inside the drum 200, may be facilitated by using the temperature sensor S1.

Figure 3:
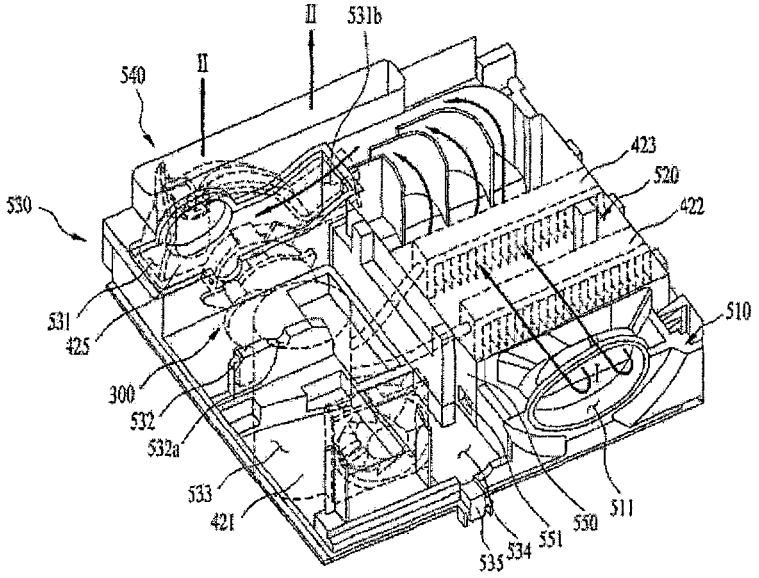
FIG. 3 is a diagram illustrating a base in which condensate is collected in the laundry treating apparatus.
Figure 3:
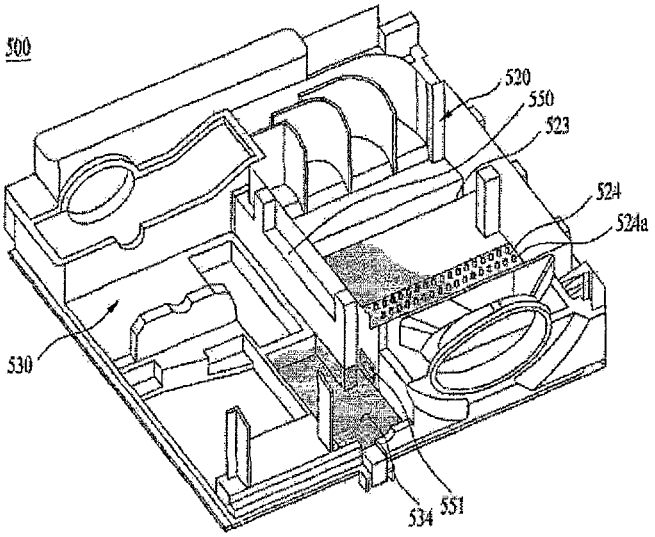

FIG. 3 is a diagram viewed from a view above a rear surface towards a front surface of the base 500. Referring to FIG. 3, view (a), the base 500 may include an outlet connection duct 510 in communication with the outlet duct 411; an air flow portion or space 520 where the evaporator 422, the condenser 423 and the expansion valve of the heat pump 420 may be installed; an inlet connection duct 540 in communication with the inlet duct 412 and configured to suck the air passed through the air flow portion 520; and a device mounting portion or space 530 partitioned off by a partition wall 550 and having several devices including the compressor 421 and the drainage pump 430 supportedly installed therein.

The air flow portion 520 may a housing that defines an air channel for the air discharged from the drum 200 that houses the evaporator 422 and the condenser 423. The air flow portion 520 may be partitioned off from the device mounting portion 530 by the partition wall 550.

The internal air of the drum 200 may not be discharged into the device mounting portion 530 past the partition wall 550 and may not collide with other devices, so as to reduce the air resistance. Devices that may need to directly contact the air discharged from the drum 200 (such as the evaporator or the condenser 423) may be installed in the air flow portion 520, and devices may not that need contact with the dry air (such as the drainage pump 430) may be installed in the device mounting portion 530.

The outlet connection duct 510 provided in a first end of the air flow portion 520 may be coupled to an outer or inner circumferential surface of the outlet duct 411, and may include a through hole 511 formed to draw the air discharged from the outlet duct 411 into the air flow portion 520. The outlet connection duct 510 may be provided to have a larger and larger area towards the air flow portion 520 from the through-hole 511. This increasing area may lower the speed of the air flow from the outlet duct 411 and then increase the heat exchange performed in the evaporator 422.

A plurality of collection ribs 521 may be provided in a second end of the air flow portion 520 to move the air passed through the condenser 423 into the inlet connection duct 540. The collection ribs 521 may lower the flow resistance of the high-temperature dry air or hot air that passed through the condenser 423 and guide it into the inlet duct 412.

The device mounting portion 530 may include a circulation fan mounting area or fan area 531 provided to partially accommodate or support the circulation fan 425 installed therein; a drive unit mounting area or drive area 532 provided to support the drive unit 300; a compressor mounting area or compressor area 533 provided to support the compressor; and a condensate collection portion or liquid chamber 534 provided to collect the water condensed from the evaporator 422. The drainage pump 430 may be provided within or coupled to an upper surface of the condensate collection portion 534.

The circulation fan 425 may be configured to provide power to blow the air towards the air flow portion 520, and the circulation fan mounting area 531 may communicate with the inlet duct 412 and the air flow portion 520.

The circulation fan mounting area 531 may have a wall that faces ends of the collection ribs 521, and the wall may have an opening to allow air to flow through the circulation fan mounting area 531. Another wall or surface of the circulation fan mounting area 531 may face the inlet duct 412, and may have an opening to supply hot air to the inlet duct 412. A shaft support area 531*a* may be provided in a wall of the circulation fan mounting area 531 that faces the drive unit mounting area 532, to support the drive shaft 320 at a first end. A pulley support area 532*a* to support a second end of the drive shaft 320 may be provided in a wall of the drive mounting area 532 that faces the compressor mounting area 533.

The evaporator 422 and the condenser 433 may be formed by connecting a plurality of heat exchange plates and a plurality of refrigerant pipes that area connected with each other. The plurality of the heat exchange plates may be formed of metal, and a refrigerant may flow through the refrigerant pipes. The heat exchange plates may be arranged in parallel with an air flow direction. The high-temperature humid air discharged from the drum 200 may be chilled while passing through the evaporator 422. At this time, the moisture is condensed to become a condensate and stored in a lower area of the air flow portion 520 or in a condensate collection portion 534. After that, the air passing the condenser 433 may be heated to become a high-temperature dry air. The high-temperature dry air may be supplied to the drum 200 and dry the laundry loaded in the drum.

Referring to FIG. 3 view (b), the air flow portion 520 may include an evaporator mounting area or evaporator area 524 provided to mount or support the evaporator; and a condenser mounting area or condensate area 523 provided to mount or support the condenser. The evaporator mounting area 524 may include a plurality of projections 524*a* to prevent foreign substances (e.g., lint) discharged from the drum 200 from coming into the condensate collection portion 534. The plurality of the projections 524*a* may be arranged along both sides of a lower end of the evaporator 422.

The condenser mounting area 523 may be provided as a groove in which a lower end of the condenser 423 may be inserted to prevent a possibility of water congestion caused by the heat generation of the condenser 423. Accordingly, the fixing between the condenser 423 may be rigidly fixed to the base 500 via a strong or durable fixing member.

Water condensed from the evaporator 422 may be collected in a bottom surface of the air flow portion 520 and flow towards the condensate collection portion 534 along a through-hole 551 penetrating the partition wall 550. The bottom surface of the air flow portion 520 may be tilted or inclined towards the through-hole 551, and the condensate collection portion 534 may be provided lower than a bottom surface of the air flow portion 520.

When the water condensed from the evaporator 422 is increased by a large amount during a laundry or a dry cycle, the condensate is likely to flow over the condensate collection portion 534, and the overflow condensate may remain at the bottom surface of the air flow portion 520 after flowing along the through-hole 551.

If a lot of condensate remains in the air flow portion 520, the condensate may be re-contained in (i.e., evaporated into) the air passing the air flow portion 520, which may include drying performance. Accordingly, condensate may be discharged via the discharge pump 430 before overflowing into the air flow portion 520 from the condensate collection portion 534.

Figure 4:
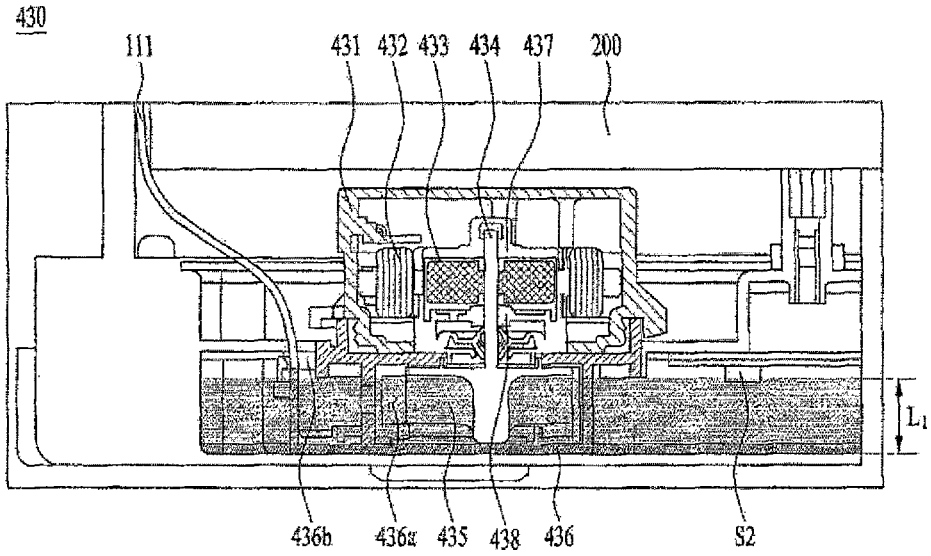
FIG. 4 is a diagram illustrating an operation of a drainage pump configured to drain the condensate of the laundry treating apparatus.
Figure 4:
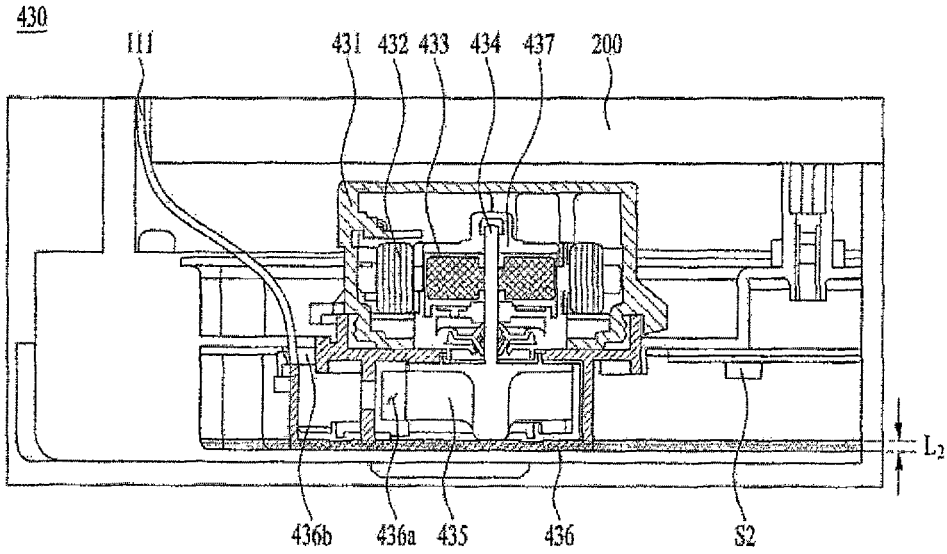

FIG. 4 is a diagram illustrating the drainage pump 430 configured to discharge water from the condensate collection portion 534.

FIG. 4, view (a) illustrates that water may be collected in the condensate collection portion 534 and FIG. 4, view (b) illustrates that the water may be discharged from the condensate collection portion 534.

The condensate collection portion 534 may include a water level sensor S2 configured to sense a water level of the condensate. When the water level sensor S2 senses that the water level reaches a reference level via a predetermined level L1 in the condensate collection portion 534, the controller P may determine that the water level has reached "a full water level" or a predetermined amount and may drive the drainage pump 430 to discharge the water from the condensate collection portion 534. The drainage pump 430 may be continuously or intermittently actuated or driven whenever the water level reaches the "full water level". Accordingly, the condensate may be prevented from overflowing to the air flow portion 520 from the condensate collection portion 534. The preset level L1, or the "full water level", may be referred to as a first water level L1. The water level sensor S2 may be a contact sensor, but embodiments disclosed herein are not limited thereto. For example, the water level sensor may be a pressure sensor, or any type of sensors capable of sensing a water level.

The drainage pump 430 may include a motor unit or drainage motor including a stator 432 configured to form a rotating field or rotating magnetic field, a rotor 433 that is rotatable by the rotating field, and a motor shaft or shaft 434 rotatable together with the rotor 433. The drainage pump 430 may further include an impeller 435 that is rotatable by being coupled to the shaft 434.

The drainage pump 430 may also include a first housing 431 provided to accommodate or support the motor unit; and a second housing 436 provided to accommodate or support the impeller 435. Water may be prevented from flowing into the first housing 431.

The motor shaft 434 and the rotor 433 are rotary independent from the stator 432 such that the drainage pump 430 may further include an inner case 437 to support the motor shaft 434 and the rotor 433.

A bearing unit or bearing 438 provided to support the motor shaft 434 may be further, provided between the first housing 431 and the second housing 436, and may be penetrated by the motor shaft 434.

A water inlet hole 436*a* formed to draw the water from the condensate collection portion 534 and a water outlet hole 436*b* formed to discharge the water from the second housing 436 may be provided in a surface of the second housing 436. An accommodation pipe or pipe 111 in communication with the condensate tank may be connected to the water outlet hole 436*b*.

Figure 5:
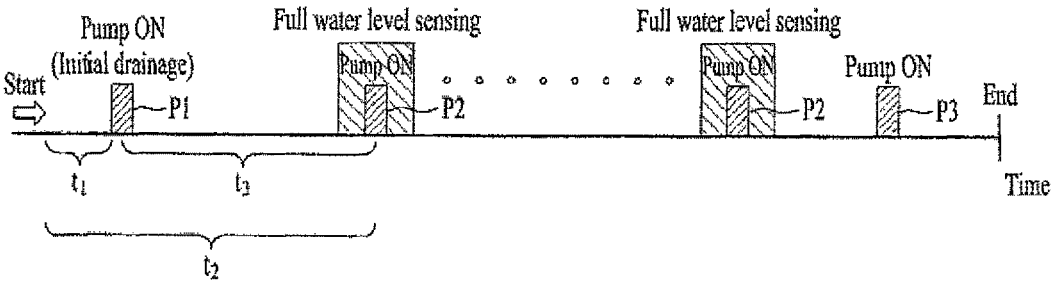
FIG. 5 is a diagram illustrating a driving method of the drainage pump when the laundry treating apparatus is in a normal state.

Accordingly, when the impeller 435 is rotated, the water may be drawn into the water inlet hole 436*a* from the condensate collection portion 534 and discharged along the water outlet hole 436*b* to be collected in the condensate tank 110. The impeller 435 may rotate at a high speed and may be spaced a preset or predetermined distance L2 apart from the condensate collection portion 534. As shown in FIG. 4, view (b), the water level may be lowered to a minimum water level, which may be at the preset distance L2, located below the impeller 435. Even when the drainage pump 430 completes the water discharging, water may remain at the minimum water level. Accordingly, the preset distance L2, or the minimum water level, may also be referred to as the second water level L2. FIG. 5 illustrates the operation of the drainage pump 430 in time order when the laundry treating apparatus 10 performs the dry cycle.

When the dry cycle of the laundry treating apparatus 10 is performed, an initial drainage step P1 may be performed to complete the drainage of the condensate collected during a former dry cycle by actuating the drainage pump 430 within a preset or predetermined reference time period t1.

As an example, in a former dry or treating cycle, the user may recognize that drying has completed before the dry cycle ends and stop an operation of the laundry treating apparatus 10. At this example, the water condensed from the evaporator 422 may remain in the condensate collection portion 534.

If moisture or water is condensed from the evaporator 422 after the dry cycle restarts, new condensate may be added to the previous condensate collected in the condensate collection portion 534 from the former dry cycle such that the water level may drastically rise enough to cause water leakage. Accordingly, when the reference time period t1 passes after the operation of the laundry treating apparatus 10 starts, the initial drainage step P1 may be performed to prevent the water leakage and overflow, even if new condensate is collected.

The initial drainage step P1 may be performed until the water level sensor S2 senses that the water level is lower than a reference value, or may be performed for a preset or predetermined time t3 period regardless of the water level sensor S2. The reference value may be the second water level L2, and the preset time period may be a time period in which all water may be drained even if the water level is the first water level L1 in the condensate collection portion 534.

After that, the laundry treating apparatus 10 may drive the drainage pump 430 whenever it is sensed that the water level of the condensate collection portion 534 is at the first water level L1. The laundry treating apparatus 10 may perform a full water level drainage step P2 which includes actuating the drainage pump 430 by actuating the hot air supply unit 400 whenever the water level of the condensate collection portion 534 is at the first water level L1 or more. The point of time at which the full water level drainage step P2 is performed may be variable according to the amount of the moisture or water contained in the laundry or the amount of the laundry.

The laundry treating apparatus 10 may perform a final drainage step P3 which includes re-actuating the drainage pump 430 when the actuation of the hot air supply unit 400 is completed to complete the drying process. The final drainage step P3 may be performed even if the water level has not reached the first water level L1, so as to remove the condensate that remains in the condensate collection portion 534. Accordingly, various safety accidents may be prevented such as condensate spoilage or water leakage in the next dry cycle.

Alternatively, the laundry treating apparatus 10 may start the operation at a point of time when the water level reaches the first water level L1, without performing an initial drainage step P1, and actuate the drainage pump 430 for a preset or predetermined time period t2.

The laundry treating apparatus 10 might be frozen or in a frozen or freezing state in the winter or other low-temperature environment unless all of the condensate is drained from the condensate collection portion 534.

In addition, even when the drainage pump 430 drains as much condensate from the condensate collection portion 534 as possible, a predetermined amount of water up to the second water level L2 could be left in a gap formed between the impeller 435 and the condensate collection portion 534. The volume of this remaining water may be expanded enough to contact the impeller 435 if the water is freezing or being frozen.

When the condensate is freezing or completely frozen and contacts the impeller 435, the drainage pump 430 might be constrained, and it could be impossible to actuate the drainage pump 430. In addition, if the drainage pump 430 is forcefully actuated or driven by a repeatedly input command to actuate or turn on the drainage pump 430 in a state where the drainage pump 430 is constrained, the drainage motor of the drainage pump 430 (including the rotor 433, the motor shaft 434, and the stator 432) may be damaged.

A constrained state may be a state where the impeller 435 is locked by ice and cannot be rotated at all or cannot be rotated below a reference rotation speed or rate. The reference rotation rate may be a rotation rate at which the impeller 435 is rotated in a normal state according to a command of the controller, or may be a minimum rotation rate that is needed to perform the command. In addition, the reference rotation rate may correspond to the rotation rate at which the impeller 435 is not constrained by ice or that is needed to overcome a constrainment by the ice.

To prevent a constrainment, the laundry treating apparatus 10 may shut off or stop a performance of the dry or treating cycle when the drainage motor or drainage pump 430 is constrained. Also, the display unit 121 may show an error message or display light indicating that the performance of the dry cycle has shut off so as to induce the user to try to continuously input an operation command.

However, when the drainage pump 430 or drainage motor is frozen and constrained, the user may have to wait until the frozen drainage pump 430 or drainage motor is naturally thawed. In addition, if a low temperature of the environment is maintained for a predetermined time period, such as during the winter season, the frozen drainage motor or drainage pump 430 may not be naturally thawed, and the user may not be able to operate the laundry treating apparatus 10 for that time period.

In addition, when the user attempts to thaw the condensate by using warm water, there might be a short circuit or damage to the drive unit 300 or input air supply unit 400. Accordingly, even when the condensate is frozen, the laundry treating apparatus 10 may actively thaw the frozen condensate and restore it to a normal state.

As mentioned above, the laundry treating apparatus 10 may display an error message or error display light on the display unit 121 if the drainage pump 430 is constrained and the dry cycle is shut off. However, the drainage pump 430 or drainage motor might be constrained for other reasons. For example, foreign substances may be drawn into the drainage pump 430, or the rotor 433 or the stator 431 may have a short circuit or other malfunction.

Thus, a frozen state, where the collected condensate in the condensate collection portion 534 is frozen, cannot be sensed based only on constrainment of drainage pump 430 or the drainage motor, i.e., the user may not be able to determine whether the error message or error display light appears due to a frozen state or some other reason.

Accordingly, the laundry treating apparatus 10 may accurately recognize and display a frozen state among many errors. The laundry treating apparatus 10 disclosed herein may accurately sense a frozen state and actively thaw frozen condensate in response.

Figure 6:
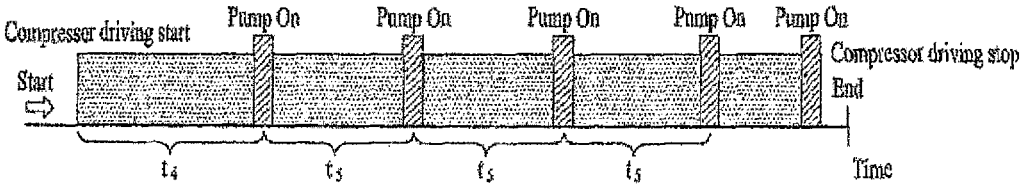
FIG. 6 is a diagram illustrating a control method for thawing the frozen condensate when the condensate is frozen in the laundry treating apparatus.
Figure 6:
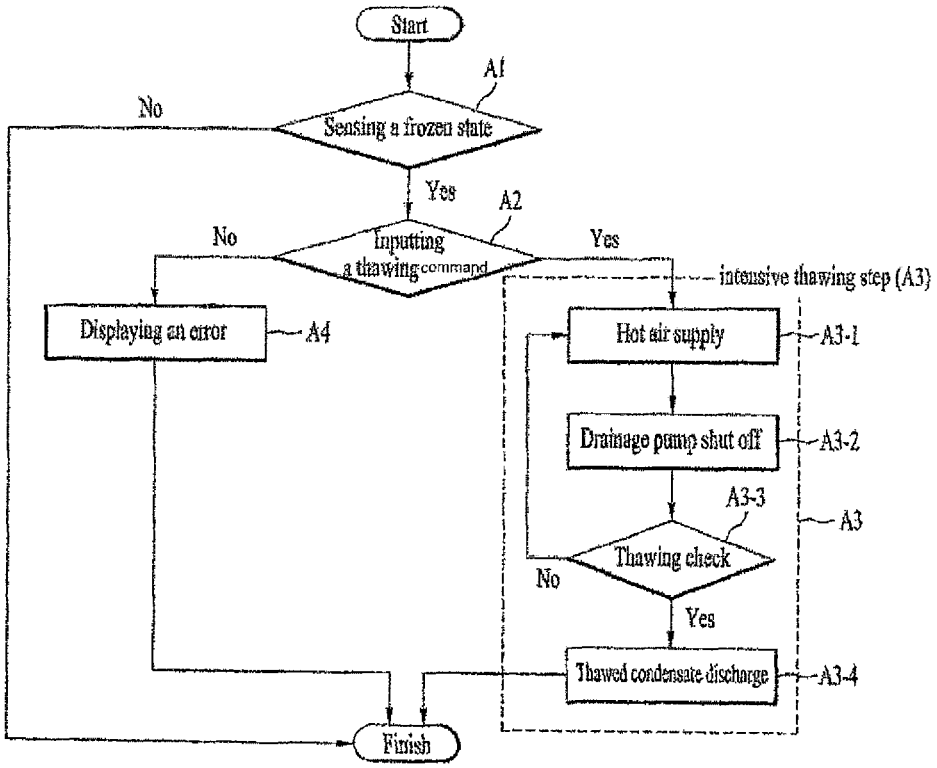

FIG. 6 illustrates a control method for recognizing, when the laundry treating apparatus 10 is in a frozen state and actively thawing the frozen laundry treating apparatus 10.

FIG. 6, view (a) illustrates an algorithm of a thawing course or method for actively thawing the frozen condensate, and FIG. 6, view (b), illustrates the operations of the hot air supply unit 400 and the drainage pump 430 that are performed in the thawing course in chronological order.

The laundry treating apparatus 10 may relatively sense whether it is in a frozen state in the frozen state sense step A1 or a user may sense that the laundry treating apparatus 10, is in a frozen state before the laundry treating apparatus 10 sense the frozen state itself, and may input a thawing input or command via the command input unit 130.

The laundry treating apparatus 10 may perform a thawing course input step or input step A2 for sensing whether the command input unit 130 senses the thawing input or command; and an intensive thawing step A3 for performing a thawing method configured to thaw the frozen condensate once the command input unit 130 senses the thawing command in the thawing course input step A2.

The intensive thawing step A3 may include a hot air supply step A3-1 for actuating at least one of the hot air supply unit 400 and the drive unit 300. Once the hot air supply unit 400 (e.g., the heat pump 420) is actuated or turned on in the hot air supply step A3-1, the heat generated in the compressor 421 may be circulated in the air flow portion 520 through the condenser 423 and the circulation fan 425, and then the heat may heat the base 500.

At the same time, the heat generated during the hot air supply step A3-1 may be transmitted or transferred to the condensate collection portion 534 via the through-hole 551. Accordingly, the frozen or freezing condensate may be provided with the heat and then thawed.

Meanwhile, the drainage pump 430 might be constrained by the frozen condensate. The intensive thawing step A3 may further include a drainage pump shut off step A3-2 for shutting off the operation of the drainage pump 430 for a reference time period t4. Accordingly, the initial drainage step P1 may be omitted in the intensive thawing step.

The reference time period t4 may be a time period for which the hot air supply unit 400 performs thawing or heating by a preset degree or amount. As an example, the reference time period t4 may be a time period in a year after the hot air supply step A3-1 is performed.

The intensive thawing step A3 may further include a thawing check step A3-3 for checking whether the thawing of the condensate collected in the condensate collection portion 534 has been performed or completed by driving the drainage pump 430, when the reference time period t4 passes.

The thawing check step A3-3 may check a thawing state by driving the drainage pump at the beginning of time interval t5 after the reference time period t4. As used herein, a time period may refer to a single period of time, while a time interval may refer to an increment of time that may be repeated.

Specifically, the thawing check step A3-3 may include a step for checking whether the impeller 435 of the drainage pump 430 is rotated by after the reference time period t4. The controller P of the laundry treating apparatus 10 may recognize the rotation of the impeller 435 based on the measured amount of currents applied to the drainage pump 430 by the drainage motor.

The controller may stop the drive or drainage motor of the drainage pump 430 unless the rotation rate of the impeller 435 reaches a reference rotation rate and may perform the hot air supply step A3 and the drainage pump shut-off step A3-2 during time interval t5. The time interval t5 may be the testing time for determining whether the condensate is thawed, and may not be the time taken to drain the condensate. As an example, the testing time may be 10. If the testing time is too long, the drainage pump 430 may be overloaded.

The controller P may check whether the thawing is normally performed or may include the speed of the thawing by sensing the rotation rate of the impeller 435 in the thawing check step A3-3. Also the controller P may adjust the time interval t5 based on the thawing state.

The laundry treating apparatus 10 in accordance with the present invention may prevent the drainage pump 430 from being forcefully driven even when the drainage pump 430 is no longer constrained due to the thawing check step A3-3. The laundry treating apparatus 10 may further sense that the thawing is not completed. The controller P may recognize that thawing is completed when it senses that the drainage pump 430 is rotated at a reference rotation rate or more.

The controller may perform a thawed water discharge step A3-4 for discharging all of the thawed water by rotating the drainage pump 430 at the reference rate or more. The thawed water discharge step A3-4 may continuously drive the drainage pump 430 when the thawing check step A3-3 senses that the drainage pump 430 is rotated at the reference rotation rate or more.

The laundry treating apparatus 10 may perform a frozen state sense step A1 for actively determining whether the condensate of the condensate collection portion 534 is frozen. The controller P may determine that the condensate of the condensate collection portion 534 is frozen when the drainage pump 430 is constrained and when the temperature sensed by the temperature sensor S1 is lower than a reference or predetermined temperature. When the drainage pump 430 is constrained and the temperature is low, then the condensate is most likely frozen and thus the controller P may determine that the condensate is frozen.

In an embodiment, the condensate may be frozen below 0° C., and so the reference temperature may be set as 0° C. However, if the temperature sensor S1 is provided in the hot air supply unit 400, the temperature may be higher than a room or ambient temperature, or a temperature of the condensate. In addition, when the hot air supply unit 400 is actuated, the temperature sensed by the temperature sensor S1 may be above 0° C. because of the heat generated in the condenser 423 even when the room temperature is below 0° C.

Accordingly, even if the condensate is actually frozen, the temperature of the air passing by the temperature sensor S1 will probably not be sensed below 0° C., and so the controller may not recognize or sense that the condensate is frozen.

The reference temperature may thus be set to a temperature or temperature range that is higher than the freezing point, or 0° C.

For example, the reference temperature may be set to 3° C. or 5° C. When the drainage pump 430 is constrained and the temperature sensed by the temperature sensor S1 according to the control of the controller P in the frozen state sense step A1 is 3° C. or 5° C. or lower, the controller P may recognize that the condensate of the condensate collection portion 534 is frozen.

The frozen state sense step A1 may be performed when the power unit 140 of the laundry treating apparatus 10 is selected and when it is sensed in the initial drainage step P1 that the drainage pump 430 is constrained. When the frozen state is sensed in the frozen state sense step A1, the controller P may display the frozen state on the display unit 121 and inform the user of the frozen state to induce the user to select a thawing command via the command input unit 130.

If the thawing course input step A2 is not performed even when the frozen state is sensed in the frozen state sense step A1, the laundry treating apparatus 10 may stop the operation and perform an error display step A4 for displaying the frozen state outside. The error display step A4 may inactivate all of the buttons, except a thawing command button or command input unit 130 or the power unit 140. That is to prevent damage to the laundry treating apparatus 10 caused by the dry cycle being forcefully performed.

When the thawing course input step A2 is performed while or before the frozen state sense step A1 is performed, the frozen state sense step A1 may be omitted. The thawing check step A3-3 may sense the presence of frozen or freezing condensate and whether to perform the thawing.

When the user recognizes that the laundry treating apparatus 10 is in the frozen state, it may be expected that the user will not load the laundry into the drum 200 and will instead input a thawing command. Accordingly, the intensive thawing step A3 may set the time input t5 as 30 minutes to minimize a testing drive of the drainage pump 430 and perform the drive of the compressor 421 to thaw the condensate collected in the base 500 more stably.

However, the laundry may be held in the drum 200, or the user may desire to dry or treat the laundry together with the thawing of the condensate. When the intensive thawing step A3 is performed, the water contained in the laundry may be collected in the condensate collection portion 534 during the intensive thawing step A3. Accordingly, a control method is needed that facilitates the drying or treating of the laundry while considering the condensate collected in the condensate collection portion 534 during the thawing course.

Figure 7:
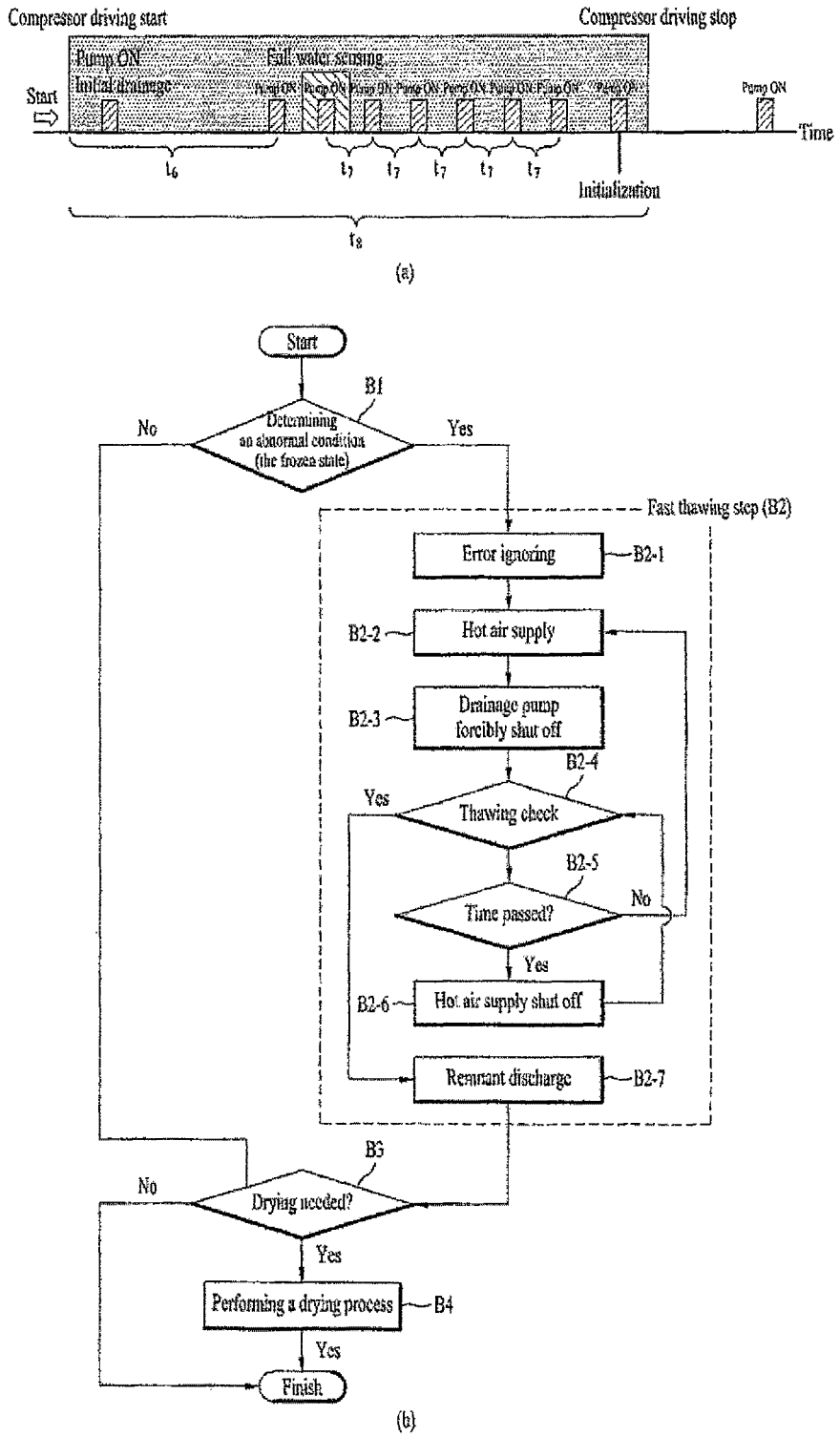
FIG. 7 is a diagram illustrating a control method for sensing the frozen condensate in the laundry treating apparatus and thawing the frozen condensate.

FIG. 7 illustrates another embodiment of the control method that may perform the thawing even when the laundry is kept in the laundry treating apparatus.

FIG. 7, view (a), illustrates a driving point of the drainage pump 430 and the compressor 421 according to a time and FIG. 7, view (b) illustrates an algorithm.

The laundry may be loaded in the drum 200 and the user may input a command for performing the dry or treat cycle to the control panel 120, regardless of whether the laundry treating apparatus is in a frozen state.

When the dry cycle is performed, the laundry treating apparatus 10 may perform an abnormal condition determining step B1 including a step for sensing whether the condensate of the condensate collection portion 534 is frozen. The abnormal condition determining step B1 may be a step for generally checking whether the dry cycle is performed normally and check whether the drainage pump 430 is constrained by the frozen condensate.

In the abnormal condition determining step B1, the controller may determine that the condensate is frozen when the drainage pump 430 is constrained and the temperature sensed by the temperature sensor S1 is at the reference temperature. Since the temperature sensor S1 provided in the hot air supply unit 400 or the drum 200 might not sense a temperature below 0° C., and the reference temperature may be set to be higher than the freezing point of water.

The initial drainage step P1 may be performed at the same time as the abnormal condition determining step B1. The drainage pump 430 may be driven in the initial drainage step P1 such that it may be sensed whether the drainage pump 430 is constrained.

When it is sensed in the abnormal condition determining step B1 whether the condensate is frozen, the laundry treating apparatus 10 may perform a fast thawing step B2 for immediately thawing the frozen condensate.

When sensing that the condensate is frozen, the laundry treating apparatus 10 may perform the thawing method configured to prevent a stop of the operation and thaw the frozen condensate immediately to prevent the delay of the dry or treating cycle. The fast thawing step B2 may perform an error ignoring step B2-1 for omitting the error display on the display unit 121 and omitting the stop of the laundry treating apparatus operation. and perform the thawing course immediately.

The fast thawing step B2 may include a hot air supply step B2-2 for performing the thawing by driving the hot air supply unit 400 and transmitting warmth even to the condensate collection portion 534. In addition, the fast thawing step B2 may include a drainage pump stopping step B2-3 for shutting off the actuation of the drainage pump 430 for a reference time period t6. The reference time period t6 may be different from the reference time period t4 of the intensive thawing step A3. Accordingly, the reference time period t6 may be referenced to as the second reference time period t6 and the reference time period t4 of the intensive thawing step A3 may be referenced to as the first reference time period t4.

The second reference time period t6 may be longer than a starting time of the hot air supply step B2-2 or the time for which the laundry treating apparatus 10 is actuated.

However, the second reference time period t6 may be a time period when the water level sensor S2 senses the first water level L1. Alternatively, the second reference time period t6 may be the time period when the water level sensor S2 senses a higher water level than a water level sensed at the start point of the hot air supply step B2-2 or the actuation of the laundry treating apparatus 10.

The second reference time period t6 is related to the water level because if the water level increases past an initial water level, the moisture or water condensed from the laundry held in the drum 200 may contain relatively more thermal energy. Accordingly, the new condensate accumulated may partially thaw the frozen condensate.

In addition, when a preset amount of new condensate accumulates or is collected, the hot air supply unit 400 may be driven for a sufficient time period such none heat is transmitted to the condensate collection portion 534. Accordingly, the second reference time period t6 may be a flexible time period that is variable according to the water level in the condensate collection portion 534. The water level that determines the second reference time period t6 may be defined as a reference water level at which a sufficient amount of water and heat to thaw the frozen condensate is supplied.

The thawing check step B2-4 may be performed in consideration of the thawing state such that the delay of the dry cycle may be shut off. After the second reference time period t6, the fast thawing step B2 may include a thawing check step B2-4 for sensing whether the condensate of the condensate collection portion 534 is thawed and whether the thawing is completed.

The thawing check step B2-4 of the fast thawing step B2 may be the same as or similar to the thawing check step of the intensive thawing step A3.

The thawing check step B2-4 may check whether the frozen condensate is thawed or currently thawing by driving the drainage pump 430 at a second time interval t7 the second reference time period that passes or driving the drainage pump 430 when the water level reaches the first water level L1.

The second time interval t7 may be shorter than the first time interval t5 of the intensive thawing step A3 (e.g., 10 minutes). If the second time interval t7 is longer than the first time interval t5, the thawing course may become longer and delay the dry cycle.

In addition, the condensate containing a high temperature heat may be continuously condensed from the laundry, and the drawn condensate may be continuously exposed to the hot air such that the condensate collection portion 534 can be thawed faster. The controller P may determine whether the thawing method is effective by checking the rotation rate of the impeller by driving the drainage pump 430 for a preset time period at the second time interval t7 after the second reference time period t6.

The second time interval t7 may be adjusted according to the thawing state. When it is sensed that the rotation rate of the drainage pump 430 reaches the reference rotation rate or more in the thawing check step B2-4, the controller P may determine that the thawing of the condensate collection portion 534 is complete. When determining that the thawing is completed, the controller P may perform a remnant discharge step B2-7 for discharging the thawed condensate of the condensate collection portion 534 and the newly collected condensate. Accordingly, the fast thawing step B2 may end.

Once the remnant discharge step B2 ends, a laundry amount sensing step B3 for determining whether the laundry is loaded may be performed. The controller P may determine a duration time of the dry cycle and the course for driving the hot air supply unit 400 by sensing the amount of the laundry loaded in the drum 200. When no laundry is loaded in the drum, the dry cycle may be omitted. When it is sensed that the laundry is loaded and the dry course or option or treating operation is determined, the controller P may perform a dry performing step or treating step B4 for supplying hot air to the laundry and rotating (or otherwise treating) the drum 200.

Even when the condensate of the condensate collection portion 534 is frozen in a state where the laundry is loaded in the drum 200, the thawing may be completed and as the dry cycle is performed. Accordingly, the condensate may be automatically thawed without the user recognizing whether the condensate is frozen such that the drying of the laundry can be always completed.

The fast thawing step B2 may include a dry shut-off step B2-6 for shutting off the actuation of the hot air supply unit 400 unless the rotation to be of the drainage pump reaches a reference rotation rate.

A third time period or total time t8 may be a time when the water level of the condensate collection portion 534 becomes higher than the first water level L1, or the time when the compressor 421 is actuated excessively. When the hot air is supplied to the drum 200 for the third time t8 or more in a state where the drainage pump 430 is not driven smoothly, the condensate might overflow from the condensate collection portion 534. Accordingly, the hot air supply may be cut off so as not to generate additional condensate. This step may promote natural thawing after the dry shut off step B2-6.

The newly supplied condensate may have a high thermal energy. Even when the room temperature is low, the frozen condensate may be continuously thawed by (the newly supplied) condensate.

The dry shut off step B2-6 may continuously supply the residual heat of the drum 200 and the laundry to the condensate collection portion 534. The dry shut off step B2-6 may be a step for shutting off only the driving of the compressor 421, and the thawing check step B2-4 may be continuously performed. Accordingly, when the rotation rate of the drainage pump 430 reaches the reference rotation rate or more during the dry shut off step B2-6, the remnant discharge step B2-7 may be performed, and the fast thawing step B2 may be completed.

Figure 8:
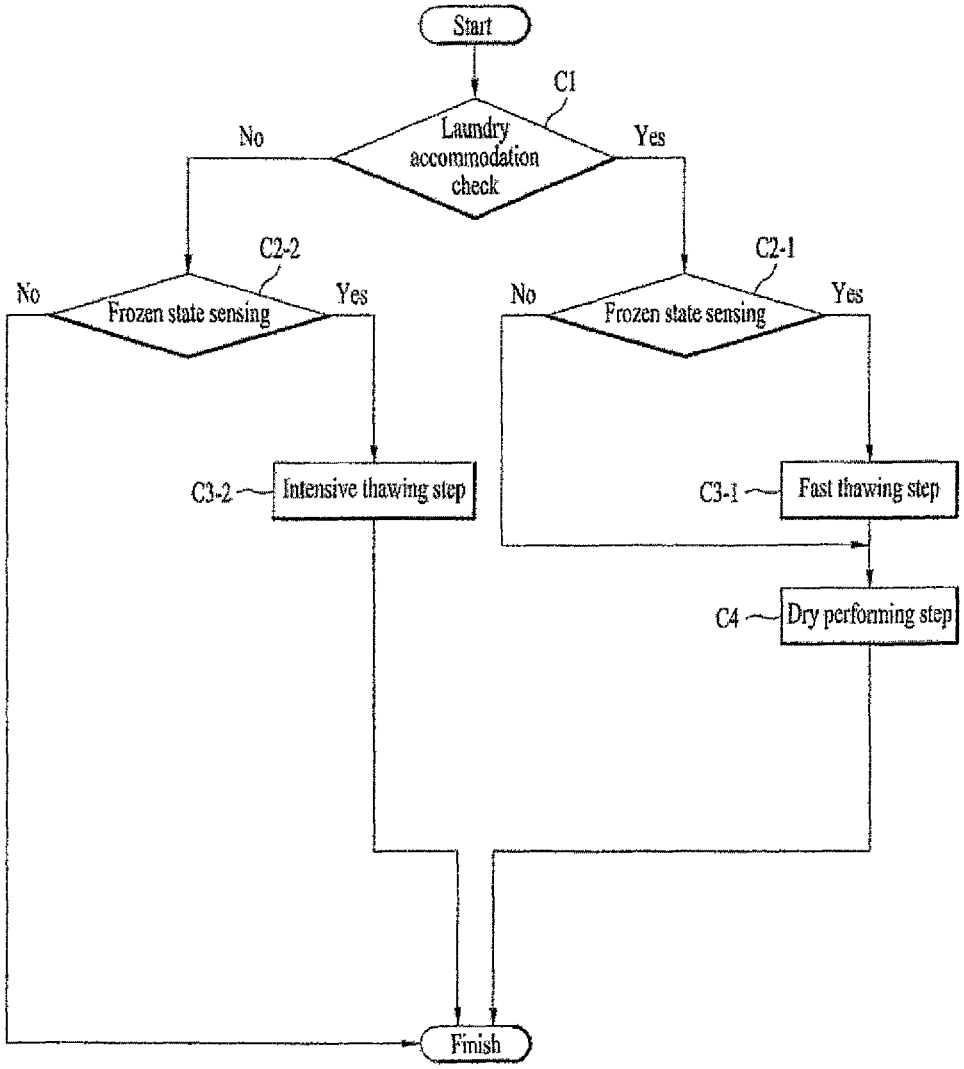
FIG. 8 is a diagram illustrating another embodiment of the control method for sensing and thawing the frozen the frozen condensate in the laundry treating apparatus.

FIG. 8 illustrates an embodiment of the control method of the laundry treating apparatus.

When the operation starts, the laundry treating apparatus 10 may perform a laundry accommodation check step C1 for checking whether the drum 200 accommodates or holds laundry by sensing an amount of the laundry. As an example, the amount of the laundry may be checked by determining an amount of electric currents applied when the drum 200 is rotated.

After it is sensed whether laundry is loaded in the laundry accommodation check step C1, a proper course or option may be determined to perform a drying or treating process based on the sensed laundry amount.

When the laundry accommodation check step C1 ends, a frozen state sensing step C2 for checking whether a frozen state is generated in the laundry treating apparatus 10 may be performed.

The frozen state sensing step C2 may be a step for sensing whether the temperature is a reference temperature or lower in a state where the drainage pump 430 is constrained.

When the laundry accommodation check step C1 senses that the drum 200 accommodates no laundry and the frozen state sensing step C2-2 senses the frozen state, an intensive thawing step C3-2 for thawing the frozen condensate may be performed. The intensive thawing step C3-2 may perform the intensive thawing for the condensate collection portion 534, without considering the drying of the laundry. The intensive thawing step C3-2 may thus be a step that prevents damage to the drainage pump 430, and may be equal to the intensive thawing step A3 shown in FIG. 6.

The intensive thawing step C3-2 may include a hot air supply step for driving one or more of the hot air supply unit 400 and the drive unit 300; a drainage pump shut off step for shutting off the drive of the drainage pump 430 for a first reference time period t4; a thawing check step for sensing the rotation rate of the impeller 435 provided in the drainage pump 430 by consistently maintaining the driving of the hot air supply unit 400 after the first reference time period t4 and intermittently driving the drainage pump 430 at the first time interval t5 at the same time; and a frozen water discharge step for discharging the thawed water by determining that the thawing is completed when the rotation rate is the reference rotation rate or more.

When the laundry accommodation check step C1 checks that the drum 200 accommodates no laundry and the frozen state sensing step C2-2 senses no frozen state, the controller may end the operation of the laundry treating apparatus 10 to prevent unnecessary power consumption.

When the laundry accommodation check step C1 senses the laundry loaded in the drum and the frozen state sensing step C2-1 senses the frozen condensate, a fast thawing step C3-1 for preparing for the dry cycle while thawing the frozen condensate may be performed. The fast thawing step C3-1 may be equal to the fast thawing step B2 shown in FIG. 6.

The fast thawing step C3-1 may include a hot air supply step for driving the drive unit 300 and the hot air supply unit 400; a drainage pump forcibly stopping step for stopping the drive of the drainage pump 430 for the second reference time period t6; a thawing check step for intermittently driving the drainage pump 430 at a second time interval 17 that is shorter than the first time interval t5 or shorter than the second reference time t6 and consistently driving the hot air supply unit 400; and a remnant discharge step for discharging the condensate when the impeller 435 is rotated at a reference rotation rate or more in the thawing check step.

The fast thawing step C3-1 may further include an error ignoring step for shutting off or stopping the laundry treating apparatus operation even when the frozen condensate is sensed. That is to prevent the delay of the dry cycle and perform the fast thawing.

The fast thawing step C3-1 may further include a hot air supply shut off step for shutting off the drive of the hot air supply unit 400 when it is sensed that the impeller 435 is not rotated at a reference rotation rate or more for a third time period or total time period t8. That is to prevent the overflow of the condensate from the condensate collection portion 534.

After that, a dry performing step C4 for completing the drying process for the laundry by performing the dry cycle, even when the remnant discharge step is or is not completed. Accordingly, the laundry treating apparatus 10 may perform the thawing of the condensate and the laundry drying at the same time. Unless the frozen state sensing step C2-1 senses the frozen state, the fast thawing step C3-1 may be omitted and the dry performing step C4 may be performed immediately.

Embodiments disclosed herein may address the above-noted and other problems and provide a laundry treating apparatus which may thaw a frozen condensate automatically, if condensate is frozen, and a control method of the same. The laundry treating apparatus may sense the frozen condensate and induce a user to take an action to thaw the frozen condensate, and a control method may control the laundry treating apparatus.

The laundry treating apparatus which may sense the frozen condensate when the condensate is frozen and may perform the thawing even without the user's recognition of the frozen condensate, and embodiments disclosed herein may provide control method of the same.

The laundry treating apparatus may prevent an overload applied to a drainage pump when thawing the frozen condensate and sense whether to perform a thawing process and whether the thawing process is completed, and a control method thereof may be provided.

The laundry treating apparatus may prevent an overflow or leakage of the condensate while thawing the frozen condensate, and a control method thereof may be provided. The laundry treating apparatus may perform the thawing process and complete the drying process, without stopping an operation or causing an error display on the outside of the laundry treating apparatus, and a control method of the same may be provided.

Embodiments disclosed herein may provide a laundry treating apparatus comprising a cabinet that defines an exterior design; a drum rotatably mounted in the cabinet and configured to accommodate or store laundry; a drive unit or motor configured to rotate the drum; a hot air supply unit or a hot air blower configured to supply high-temperature air to the drum, in communication with the drum; a collection portion or liquid chamber to collect the water condensed from the drum, in communication with the hot air supply unit; a drainage pump configured to discharge the water collected in the collection portion outside the cabinet; and a controller implemented to control the operations of the drive unit, the hot air supply unit and the drainage pump. The laundry treating apparatus may further comprise a thawing command input unit or a command input assembly configured to input a command or thawing command for thawing the water of the collection portion to the controller. When the thawing command is selected or input, the thawing command may be transmit to the controller and/or the controller may sense the thawing command. The controller may drive one or more of the hot air supply unit and the drive unit when the thawing command is selected in the thawing command input unit, and shut off the drive of the drainage pump for a reference time period. Heat may be supplied to thaw the frozen condensate by shutting off the drive of the drainage pump for the reference time, while the damage to the drainage pump may be prevented.

The controller may check a state where the thawing of the condensate collected in the collection portion is performed or whether the thawing is completed by driving the drainage pump when the reference time passes. Accordingly, the thawing may be recognized only by using only the drainage pump.

The controller may check a thawed state of the frozen condensate by driving the drainage pump at a third or repeated time interval after the reference time. The controller may check that the collection portion is thawed by sensing that the rotation number or rate of the drainage pump is a reference rotation number or more. The controller may discharge the thawed condensate by driving the drainage pump when the thawing is completed.

The laundry treating apparatus may further comprise a temperature sensor configured to sense the temperature of the drum or the hot air supply unit. The controller may determine that the condensate of the collection portion is frozen when sensing that the sensed temperature is lower than a reference temperature, or when the drainage pump is driven at a reference rotation number or less. Accordingly, an auxiliary configuration for sensing the frozen state may be omitted. The reference temperature may be higher than the freezing point of water. Even when the temperature of the area where the temperature sensor is higher than the temperature of the collection area, the frozen state may be figured out or calculated in consideration of that. The controller may stop the operation of one or more of the drive unit, the hot air supply unit and the drainage pump when it is sensed that the condensate of the collection portion is frozen but that the thawing command input unit is not selected.

Embodiments disclosed herein may provide a control method of a laundry treating apparatus comprising a cabinet that defines an exterior design; a drum rotatably mounted in the cabinet and configured to accommodate laundry; a drive unit or drive configured to rotate the drum; a hot air supply unit or hot air blower configured to supply high-temperature air to the drum, in communication with the drum; a collection portion or liquid chamber provided to collect the water condensed from the drum, in communication with the hot air supply unit; a drainage pump configured to discharge the water collected in the collection portion outside the cabinet; a controller implemented to control the operations of the drive unit, the hot air supply unit and the drainage pump; and a thawing command input unit or command input unit configured to input a command or thawing command for thawing the water of the collection portion to the controller, the control method comprising: a thawing course input step or thawing input step for sensing an input of the thawing command input unit; and an intensive thawing step for transferring heat to the collection portion by driving the hot air supply unit.

The intensive thawing step may comprise a hot air supply step for transferring warmth or heat to the collection portion by driving the hot air supply unit; and a drainage pump shut off step for shutting off the drive of the drainage pump for a reference time period. The drainage pump shut off step for preventing the damage to the drainage pump may be provided and the damage may be prevented while heat is supplied.

The control method of the laundry treating apparatus may further comprise a thawing check step for sensing one or more of a state where the condensate of the collection portion is thawed and whether the thawing is completed. The delay of the thawing course may be prevented by checking the thawing state in real time. Unless the thawing course is normally delayed, it is displayed on the display unit to induce the user to take an active action for that.

The thawing check step may sense a rotation number or rate of the drainage pump while driving the drainage pump at a first time interval or repeated time interval after the reference time. Accordingly, the heat supply for a long time may be shut off. The thawing check step may determine that the thawing is completed when the drainage pump is driven at a reference rotation number or more after the reference time. Accordingly, the constraining of the drainage pump is released and it may be determined that the thawing is completed.

The control method of the laundry treating apparatus may further comprise a frozen state sensing step for determining whether the condensate of the collection portion is frozen. At this time, the control method of the laundry treating apparatus may further comprise a display unit or display configured to display a state of the laundry treating apparatus. The control method may further comprise an error display step for displaying an error on the display unit when it is sensed that the condensate of the collection portion is frozen, but the input of the thawing command input unit is not sensed, and stopping the operation of the laundry treating apparatus. Accordingly, the frozen state may be sensed actively such that the user may be induced to perform the thawing course.

Embodiments disclosed herein may provide a control method of a laundry treating apparatus comprising a drum rotatably mounted in the cabinet and configured to accommodate laundry; a drive unit or drive configured to rotate the drum; a hot air supply unit or hot air blower configured to supply high-temperature air to the drum, in communication with the drum; a collection portion or liquid chamber provided to collect the water condensed from the drum, in communication with the hot air supply unit; and a drainage pump configured to discharge the water collected in the collection portion outside the cabinet. The control method may comprise an abnormal condition determining step for sensing whether the condensate of the collection portion is frozen.

The control method of the laundry treating apparatus may further comprise a temperature sensor configured to sense a temperature of one or more of the drum and the hot air supply unit, wherein the abnormal condition determining step determines whether the condensate of the collection portion is frozen or whether the laundry treating apparatus is in an abnormal state by sensing that the drainage pump is driven at a reference rotation number or rate or less, with the temperature being a reference temperature or less.

The reference temperature may be higher than the freezing point of water. It may be sensed whether the collection portion is frozen, considering an overall state such as the heat supplied by the hot air supply unit and the warmth as temperature inside the laundry treating apparatus.

The laundry treating apparatus may further comprise a controller implemented to stop the operation of the laundry treating apparatus when sensing an abnormal state including the constraining of the drainage pump. The control method of the laundry treating apparatus may further comprise an error ignoring step for implementing the controller to shut off the stop of the laundry treating apparatus when sensing that the condensate of the collection portion is frozen. Accordingly, the thawing course may be performed actively without stopping the operation of the laundry treating apparatus. In other words, the control method of the laundry treating apparatus may further comprise a fast thawing step for transferring heat to the collection portion by driving the hot air supply unit when sensing that the condensate of the collection portion is frozen.

The fast thawing step may comprise a hot air supply step for transferring warmth even to the collection portion by driving the hot air supply unit; and a drainage pump forcibly stopping step for shutting off the operation of the drainage pump for a reference time period. Accordingly, the damage to the drainage pump caused during the thawing process may be prevented.

The control method of the laundry treating apparatus may further comprise a thawing check step for sensing one or more of a state where the condensate of the collection portion is thawed and whether the thawing is completed. Accordingly, it may be prevented that the thawing course is continued unless sensing that the thawing is completed.

The control method of the laundry treating apparatus may further comprise a water level sensor configured to sense a water level of the collection area, wherein the thawing check step checks the thawed state by driving the drainage pump, when the reference time passes or the water level reaches a reference water level.

The drawing check step may check the thawing state by driving the drainage pump at a second time interval from when the water level reaches the reference water level.

The control method of the laundry treating apparatus may further comprise a drying shut off step for shutting off the drive of the hot air supply unit unless the rotation number of the drainage pump reaches a reference rotation number or more for a third time period during the thawing check step. Accordingly, the moisture or water contained in the laundry may not accumulate in the collection area.

The hot air supply unit may comprise a heat pump configured to supply hot air to the drum; and a circulation fan configured to circulate air inside the drum and the hot air supply unit, and the drying shut off step drives the circulation fan. Accordingly, a natural thawing may be expected.

The thawing check step may determine that the thawing of the collection portion is completed when sensing that the drainage pump is rotated at the reference rotation number or more, and the thawing check step may comprise a remnant discharge step for discharging the condensate of the collection area when determining that the thawing is completed.

A laundry amount sensing step for sensing whether the laundry is loaded in the drum may be performed when the remnant discharge step ends, and a dry performing step for supplying hot air to the laundry and rotating the drum may be performed when it is sensed that the laundry is loaded in the drum.

A laundry treating apparatus may comprise a drum rotatably mounted in the cabinet and configured to accommodate or hold laundry; a drive unit or drive configured to rotate the drum; a hot air supply unit or hot air blower configured to supply high-temperature air to the drum, in communication with the drum; a collection portion or liquid chamber provided to collect the water condensed from the drum, in communication with the hot air supply unit; a drainage pump configured to discharge the water collected in the collection portion outside the cabinet; and a temperature sensor configured to sense the temperature of the drum or the hot air supply unit. A control method of the laundry treating apparatus may comprise a laundry accommodation check step for checking whether the drum accommodates the laundry by rotating the drum; and a frozen state sensing step for sensing whether the condensate collected in the collection portion is frozen by sensing that the drainage pump is driven at a reference rotation number or rate or less with the temperature being a reference temperature or less.

The control method of the laundry treating apparatus may further comprise a thawing step for thawing the collection portion by driving the hot air supply unit when the frozen state is sensed. When it is sensed that the drum accommodates no laundry and the frozen state is sensed, an intensive thawing step for thawing the collection portion is performed by consistently driving the hot air supply unit and driving the drainage pump at a first time interval only after a reference time. A fast thawing step for thawing the collection portion may be performed by consistently driving the hot air supply unit and driving the drainage pump at the second time interval, that is shorter than the first time interval, only after the reference time. In other words, the thawing course may be selectively and properly performed according to the presence of the laundry.

The control method of the laundry treating apparatus may further comprise an error ignoring step for implementing the controller to shut off the stop of the laundry treating apparatus operation, when it is sensed that the condensate of the collection portion is frozen. In the error ignoring step, the controller may continue operation of the laundry treating apparatus.

The laundry treating apparatus may be capable of thawing a frozen condensate automatically, if condensate is frozen. Furthermore, the laundry treating apparatus may be capable of sensing the frozen condensate and inducing a user to take an action to thaw the frozen condensate.

Still further, the laundry treating apparatus may be capable of sensing the frozen condensate when the condensate is frozen and performing the thawing even without the user's recognition of the frozen condensate. The laundry treating apparatus may be capable of preventing an overload applied to a drainage pump when thawing the frozen condensate and sensing whether to perform a thawing process and whether the thawing process is completed.

Still further, the laundry treating apparatus may be capable of preventing an overflow or leakage of the condensate while thawing the frozen condensate. The laundry treating apparatus may be capable of performing the thawing process and complete even the drying process or other operation, without the stop of the operation or causing an error display on the outside of the laundry treating apparatus.

Further scope of applicability of the present disclosure will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore ail changes and modifications that fall within the metes and bounds of the claims, or equivalents of such metes and bounds, are therefore intended to be embraced by the appended claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus comprising:

a cabinet;

a drum provided in the cabinet and configured to accommodate laundry;

a motor configured to rotate the drum;

a hot air supply unit in communication with the drum to supply high-temperature air to the drum;

a liquid chamber in communication with the hot air supply unit to be supplied high-temperature air and to collect water formed from vapor discharged from the drum;

a drainage pump configured to discharge the water collected in the liquid chamber outside the cabinet;

a controller configured to control the motor, the hot air supply unit, and the drainage pump; and a thawing command input unit provided on the cabinet to receive a thawing command for thawing frozen water of the liquid chamber, wherein the liquid chamber is provided to be separated and spaced apart from the hot air supply unit.

2. The laundry treating apparatus of claim 1, wherein, when the thawing command is received, the controller is configured to drive one or more of the hot air supply unit and the motor, and is further configured to shut off the drainage pump for a reference time period.

3. The laundry treating apparatus of claim 2, wherein, if the reference time period passes, the controller is configured to drive the drainage pump to check whether the thawing of the frozen water has been performed or completed.

4. The laundry treating apparatus of claim 3, wherein the controller is configured to drive the drainage pump at a first time interval after the reference time period to check whether the thawing of the frozen water has been completed.

5. The laundry treating apparatus of claim 3, wherein the controller is configured to check that the thawing of the frozen water is completed by sensing whether a rotation rate of an impeller of the drainage pump is at or above a reference rotation rate.

6. The laundry treating apparatus of claim 5, wherein the controller is configured to discharge water collected in the liquid chamber by driving the drainage pump when the controller determines that the thawing of the frozen water is completed.

7. The laundry treating apparatus of claim 1, further comprising a temperature sensor configured to sense a temperature of the drum or the hot air supply unit, wherein the controller determines that the water in the liquid chamber is frozen when the temperature sensor senses a temperature lower than a reference temperature or when the controller senses that a rotation rate of an impeller of the drainage pump is at or below a reference rotation rate.

8. The laundry treating apparatus of claim 7, wherein the reference temperature is higher than a freezing point of the water.

9. The laundry treating apparatus of claim 7, wherein, when the controller determines that the water of the liquid chamber is frozen but does not sense the thawing command, the controller is configured to stop an operation of one or more of the motor, the hot air supply unit, and the drainage pump.

10. A control method of a laundry treating apparatus comprising:

a thawing input step for sensing an input of a thawing command that is received by a thawing command input unit of the laundry treating apparatus; and an intensive thawing step for transferring heat to a liquid chamber of the laundry treating apparatus by driving a hot air supply unit of the laundry treating apparatus, wherein the hot air supply unit is in communication with the liquid chamber to supply hot air to the liquid chamber, the liquid chamber collects condensation from a drum that holds laundry of the laundry treating apparatus, and the liquid chamber is separated and spaced apart from the hot air supply unit.

11. The control method of claim 10, wherein the intensive thawing step comprises:

a hot air supply step for transferring heat to the liquid chamber by driving the hot air supply unit; and a drainage pump shut-off step for stopping a drainage pump for a predetermined time period.

12. The control method of claim 10, further comprising a thawing check step for sensing whether condensation in the liquid chamber is thawed.

13. The control method of claim 12, wherein sensing whether the condensation is thawed includes sensing a rotation rate of an impeller of the drainage pump while driving the drainage pump at a first time interval after the predetermined time period.

14. The control method of claim 13, wherein the thawing check step includes determining that the thawing is completed when the sensed rotation rate is at or above a reference rotation rate.

15. The control method of claim 10, further comprising a frozen state sensing step for determining whether the condensation in the liquid chamber is frozen.

16. The control method of claim 15, further comprising an error display step for stopping an operation of the laundry treating apparatus and displaying an error on a display of the laundry treating apparatus when it is determined that the condensation of the liquid chamber is frozen but the thawing command is not received.

17. A control method of a laundry treating apparatus comprising determining whether water condensed in a drum of a laundry treating apparatus and accumulated in a liquid chamber is freezing or frozen, wherein the laundry treating apparatus includes a motor that rotates the drum, a hot air blower configured to supply high-temperature air to the drum and that is in communication with the liquid chamber and the drum to supply high-temperature air to the drum and the liquid chamber, the liquid chamber being separated and spaced apart from the hot air blower, and a drainage pump configured to discharge water collected in the liquid chamber to an outside.

18. The control method of claim 17, comprising:

sensing a rotation rate of an impeller of the drainage pump of the laundry treating apparatus; and sensing a temperature of one or more of the drum or the hot air blower via a temperature sensor, determining that the water of the liquid chamber is freezing or frozen when the sensed rotation rate is at a reference rotation rate or less, and the sensed temperature is at a reference temperature or less.

19. The control method of claim 18, wherein the reference temperature is higher than the freezing point of water.

20. The control method of claim 17, further comprising an error ignoring step for implementing a controller of the laundry treating apparatus to control an operation of at least one of the drum or the hot air blower when the controller determines that the water in the liquid chamber is freezing or frozen.

21. The control method of claim 17, further comprising a fast thawing step for transferring heat to the liquid chamber by driving the hot air blower after determining that the water in the liquid chamber is freezing or frozen.

22. The control method of claim 21, wherein the fast thawing step comprises:

a hot air supply step for transferring heat to the liquid chamber by driving the hot air blower; and a drainage pump stopping step for stopping an operation of the drainage pump for a predetermined time period.

23. The control method of claim 22, further comprising a thawing check step for sensing whether at least some water in the liquid chamber is thawed.

24. The control method of claim 23, wherein the thawing check step includes driving the drainage pump when the reference time passes or when a water level sensor senses, via a water level sensor, that a water level of the liquid chamber is at or above a reference water level.

25. The control method of claim 24, wherein the thawing check step further includes driving the drainage pump at a second time interval after the water level reaches the reference water level.

26. The control method of claim 24, further comprising a treating shut-off step for stopping the hot air blower until a rotation rate of an impeller of the drainage pump reaches a reference rotation rate or more within a second predetermined time period during the thawing check step.

27. The control method of claim 26, wherein the hot air blower comprises:

a heat pump configured to supply hot air to the drum; and a circulation fan configured to circulate air inside the drum and the hot air blower, wherein the treating shut-off step further includes driving the circulation fan.

28. The control method of claim 26, wherein the thawing check step further includes determining that thawing of the water is completed after sensing that the impeller is rotated at the reference rotation rate or more, and the control method further comprises a remnant discharge step for discharging the water of the liquid chamber after determining that the thawing is completed.

29. The control method of claim 28, further comprising:

a laundry amount sensing step for sensing whether laundry is loaded in the drum after performing the remnant discharge step, and a dry performing step for supplying hot air to the laundry and rotating the drum when it is sensed that laundry is loaded in the drum.

30. A laundry treating apparatus comprising:

a cabinet;

a drum provided in the cabinet and configured to accommodate laundry;

a motor configured to rotate the drum;

a hot air blower to supply high-temperature air to the drum;

a liquid chamber configured to be supplied with high-temperature air from the hot air blower and to collect water formed from vapor discharged from the drum;

a drainage pump configured to discharge the water collected in the liquid chamber outside the cabinet;

a controller configured to control the motor, the hot air blower, and the drainage pump; and a command input interface provided on the cabinet to receive a thawing command for thawing frozen water of the liquid chamber via the high-temperature air from the hot air blower, wherein the liquid chamber is spaced apart from the hot air blower.

31. The laundry treating apparatus of claim 30, wherein:

when the thawing command is received, the controller is configured to drive one or more of the hot air blower and the motor, and is further configured to shut off the drainage pump for a reference time period, and if the reference time period passes, the controller is configured to drive the drainage pump to check whether the thawing of the frozen water has been performed or completed.

32. The laundry treating apparatus of claim 31, wherein the controller is configured to drive the drainage pump at a first time interval after the reference time period to check whether the thawing of the frozen water has been completed.

33. The laundry treating apparatus of claim 31, wherein the controller is configured to check that the thawing of the frozen water is completed by sensing whether a rotation rate of an impeller of the drainage pump is at or above a reference rotation rate, and the controller is configured to discharge water collected in the liquid chamber by driving the drainage pump when the controller determines that the thawing of the frozen water is completed.

34. The laundry treating apparatus of claim 31, further comprising a temperature sensor configured to sense a temperature of the drum or the hot air blower, wherein:

the controller determines that the water in the liquid chamber is frozen when the temperature sensor senses a temperature lower than a reference temperature or when the controller senses that a rotation rate of an impeller of the drainage pump is at or below a reference rotation rate, and when the controller determines that the water of the liquid chamber is frozen but does not sense the thawing command, the controller is configured to stop an operation of one or more of the motor, the hot air blower, and the drainage pump.

* * * * *